US006691467B2

(12) United States Patent
Hincher, Sr.

(10) Patent No.: US 6,691,467 B2
(45) **Date of Patent: *Feb. 17, 2004**

(54) ILLUMINATED SECURITY GATE WITH OPTIONAL AUDIBLE ALARM

(76) Inventor: William M. Hincher, Sr., 23 Pittenger Pond Rd., Freehold, NJ (US) 07728

( * ) Notice: Subject to any disclaimer, the term of this patent is extended or adjusted under 35 U.S.C. 154(b) by 0 days.

This patent is subject to a terminal disclaimer.

(21) Appl. No.: 09/887,440

(22) Filed: Jun. 25, 2001

(65) Prior Publication Data

US 2002/0194786 A1 Dec. 26, 2002

(51) Int. Cl.[7] ..... E06B 9/01
(52) U.S. Cl. ..... 49/463; 49/57; 362/152
(58) Field of Search ..... 49/57, 55, 463, 49/25; 362/145, 152

(56) References Cited

U.S. PATENT DOCUMENTS 1,314,513 A * 9/1919 Donahue ..... 52/28
1,609,055 A * 11/1926 Booth ..... 338/219
1,831,052 A * 11/1931 Weichelt ..... 338/73
2,277,784 A * 3/1942 Schlemmer et al. ..... 362/227
2,512,954 A * 6/1950 Marks ..... 119/841
3,203,052 A * 8/1965 Curtis ..... 49/70
3,867,621 A 2/1975 Gewfitz
4,204,196 A * 5/1980 Sveda ..... 340/309.15
4,349,748 A * 9/1982 Goldstein et al. ..... 307/132 E
4,400,696 A * 8/1983 Klingensmith ..... 340/573.3
4,422,068 A * 12/1983 Helft et al. ..... 340/514
4,427,975 A * 1/1984 Kinzie ..... 340/547
4,520,592 A 6/1985 Holloway
4,716,402 A * 12/1987 Francis ..... 340/546
4,763,937 A * 8/1988 Sittnick et al. ..... 292/251.5
4,808,974 A * 2/1989 Cantley ..... 340/546
4,851,814 A * 7/1989 Rehberg ..... 340/546
5,056,262 A * 10/1991 Schweiss et al. ..... 49/56
5,063,372 A * 11/1991 Gillett ..... 340/547
5,065,136 A * 11/1991 Frolov et al. ..... 340/545.2
5,179,325 A * 1/1993 Aragon, Jr. ..... 315/136
5,243,325 A * 9/1993 Marin et al. ..... 340/545
5,282,337 A * 2/1994 Duhame et al. ..... 49/199
5,396,732 A 3/1995 Andersen
5,437,115 A 8/1995 Freese et al.
5,457,914 A 10/1995 Johnson, Jr.
5,488,195 A * 1/1996 Mickel ..... 84/609
5,532,560 A 7/1996 Element et al.
5,535,552 A 7/1996 Stern
5,568,123 A * 10/1996 Derheim ..... 340/545.2
5,594,428 A * 1/1997 Peterson ..... 340/825.36
5,680,094 A * 10/1997 Guim et al. ..... 340/332
5,686,890 A * 11/1997 Ko ..... 340/545.1
5,782,036 A 7/1998 Bertieri et al.
5,809,694 A 9/1998 Postans
5,867,099 A 2/1999 Keeter
5,867,107 A * 2/1999 Gartner ..... 340/5.31
5,887,856 A 3/1999 Everly, II
6,035,676 A * 3/2000 Hudspeth ..... 70/278.1
6,049,276 A * 4/2000 Agozzino ..... 340/545.1
6,079,157 A 6/2000 Hincher
6,278,366 B1 * 8/2001 Flecther et al. ..... 340/542
6,292,100 B1 * 9/2001 Dowling ..... 340/545.6
6,347,486 B1 * 2/2002 Badillet ..... 49/394
6,427,383 B1 * 8/2002 Brooks et al. ..... 49/141
6,454,324 B1 * 9/2002 Lewis et al. ..... 292/371.16

* cited by examiner

*Primary Examiner*—Gregory J Strimbu
(74) *Attorney, Agent, or Firm*—Siemens Patent Services, LC

(57) ABSTRACT

An illuminated safety or security gate having an optional audible alarm device. The gate includes an electrically operated light adapted to illuminate the gate directly, to project a visible signal away from the gate, or both. The gate includes an electrical system having a power source to supply power, controls, and conductors connecting the light, power source, and controls. Optionally, the controls include a programmable timer, a light-sensitive (photo-electric) controller or a motion sensor to control operation of the light, and a manual switch which controls intensity of the light. Additionally, the motion sensor controls both the light and the audible alarm. The various controls may be combined if desired. A remote controller is optionally provided.

15 Claims, 3 Drawing Sheets

ILLUMINATED SECURITY GATE WITH OPTIONAL AUDIBLE ALARM

This application is related to previous application Ser. No. 09/249,293, filed on Feb. 12, 1999, and issued as U.S. Pat. No. 6,079,157, on Jun. 27, 2000.

BACKGROUND OF THE INVENTION

1. Field of the Invention

The present invention relates primarily to portable, removable security gates and barriers (hereinafter, "gates") of the type temporarily installed in hallways and doorways of buildings for the purpose of preventing children and pets from passing into areas from which they are to be excluded. More particularly, the invention improves upon prior art gates by adding both an illuminated warning beacon and an optional audible alarm, enabling persons to see and/or hear the gate in the dark. This invention finds utility in any building or controlled exterior area wherein a gate is placed, and where a person may possibly stumble over or walk into the gate if the latter is not visible due to darkness.

2. Description of the Prior Art

Security gates are employed from time to time to prevent children and pets from gaining access to certain areas within a building, such as a home. A gate normally has apparatus for temporary and removable engagement of wall and door jamb surfaces for mounting, although they may be permanently installed, as well. The gate may remain in place for days, weeks, or months during a period when it is desired to control access of children and pets to specific portions of a building. If a gate remains in place overnight, or during other conditions when it is obscured by darkness, then it is possible for people to walk into or stumble over the gate. This may arise due to forgetfulness or because a visitor to the house is unfamiliar with the gate.

In many cases, little serious injury or damage ensues. However, in some situations such as a gate placed at the top of a flight of stairs, injury can potentially be severe. Should a person fall over or past the gate, he or she could possibly fall down the flight of stairs. Potential consequences of such an occurrence are extreme.

Apart from hazard of injury and the nuisance of being obliged to reinstall the gate, a person walking into the gate may cause damage to the building. It is an easy matter for the apparatus engaging a building wall or door jamb to chip paint or to gouge a hole or scratch into an architectural finish such as paint.

The prior art has provided security gates with various amenities. U.S. Pat. No. 5,437,115, issued to T. Brent Freese et al. on Aug. 1, 1995, U.S. Pat. No. 5,457,914, issued to Marvin B. Johnson on Oct. 17, 1995, U.S. Pat. No. 5,535,552, issued to Carl M. Stern on Jul. 16, 1996, and U.S. Pat. No. 5,809,694, issued to Mark Anthony Postans on Sep. 22, 1998, all illustrate security gates which are used to control access within buildings. In each case, the subject gate lacks both the illuminated beacon and audible alarm as seen in the present invention, and controls and power supply associated with the novel gate.

None of the above inventions and patents, taken either singly or in combination, is seen to describe the instant invention as claimed.

SUMMARY OF THE INVENTION

The present invention improves upon security gates by providing an illuminated beacon and optional audible alarm so that a security gate may be seen and/or heard at night and during other conditions of darkness. The improved gate has both manual and automatic control features activating and inhibiting operation of the illuminated beacon and audible alarm. Illumination emanates from one or more fixtures mounted on the gate. In various embodiments, the fixture illuminates the gate itself or transmits a visible signal away from the gate, or several fixtures both illuminate the gate and also transmit a visible signal. The illumination beacon warns passers by of the presence of the gate regardless of the nature of the beacon. Either type of beacon may constantly be on or may flash intermittently.

The beacon is controlled by manual control, automatic control, or both. Operation of the beacon is inhibited in two embodiments by a photoelectric cell, which enables operation only in dark conditions, or by a programmable timer. In alternate embodiments, the beacon may normally remain off, illuminating responsive to detection of motion by an integral motion detector, in which case an audible alarm may also be incorporated into the design. Intensity of light may be controlled manually in discrete steps or progressively by a dimmer switch.

The gate itself may be of any known type. Illustratively, it may comprise a fixed barrier that permanently obstructs a walkway, doorway, corridor, or the like as long as it is in place. As an alternative to a fixed barrier, the gate may be the pass-through type comprising a gate, either temporary or permanently installed. The gate may comprise a single panel which engages two opposed vertical surfaces by pressure. This type of gate will be called a pressure mounted gate. Alternatively, it may be of a type having parallel sliding panels which open to allow passage. In a further alternative, the gate may have a telescoping or scissors action, expansible barrier. In still another alternative, the gate may have a panel which rotates about a generally vertical axis.

The gate may have diverse apparatus for holding itself in place other than being horizontally expansible. For example, it may have eyes which receive fasteners which are driven into a wall or other vertical environmental surface. This type will be called a wall mounted gate. The gate is modified from conventional construction to contain one or more batteries, lighting fixtures, audible alarm and controls. The controls optionally include a remote controller to enable the beacon to be controlled remotely.

Accordingly, it is one object of the invention to render a security gate visible in dark conditions.

It is another object of the invention to provide a security gate with an illuminated beacon.

It is a further object of the invention to control when the illuminated beacon operates.

Still another object of the invention is to operate the beacon automatically under dark conditions.

A further object of the invention is to operate the beacon when a person or animal is moving in the vicinity of the novel gate.

Another object of the invention is to provide an optional audible alarm activated by motion sensor when a person or animal is in the vicinity of the gate.

An additional object of the invention is that the gate have its own power supply and controls carried thereon.

Still a further object of the invention is selectively to illuminate the gate and to project a visible signal warning of the presence of the gate.

Yet another object of the invention is to control intensity of the beacon.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
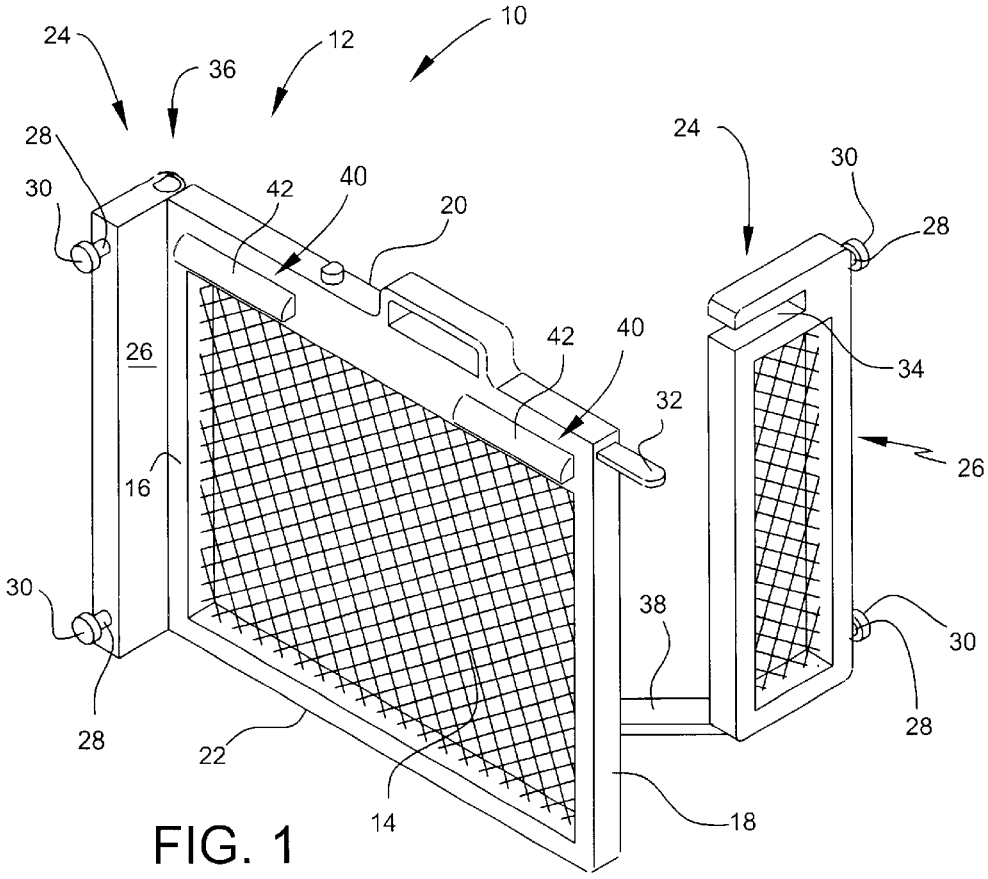
FIG. 1 is a perspective view of one embodiment of the invention.

FIG. 1 of the drawings shows an illuminated, portable, removable safety gate 10 of the type employed for obstructing a passageway (not shown). Passageways that are controlled by gate 10 are typically corridors, doorways, fence opening and other points along areas intended for human occupancy and use. Such passageways may be bounded by walls, partitions, and other structural or architectural features which constrain people to travel along the passageway but not to depart laterally therefrom. For purposes of discussion of the present invention, the interior or tailgate of a motor vehicle will also be considered a passageway as the gate 10 could be used to constrain pets or cargo in the rear of a vehicle.

For the purposes of this invention, gate 10 may be either of the type permanently obstructing a passageway as long as the gate is installed along the passageway, or alternatively a device intended to facilitate authorized passage. In most cases, passage requires merely the ability to open the gate 10, as gates are typically intended to deny passage to children and pets. Gates facilitating passage include those having a panel which pivots about a vertical axis, those which expand to obstruct a passageway but can be compressed to create an opening or gap, and those having parallel upright panels which telescope to create an opening or gap. The novel improvements are equally applicable to all varieties of gates, including permanent gates, such as in an outdoor fence. For purposes of disclosure, however, a temporary, swinging gate will be used, depicting a typical mounting method for such a gate. Since the novel improvements are applicable to all gate types, the method of mounting is, likewise, immaterial to the invention and may be either temporary or permanent.

All gates 10 encompassed by the present invention share similar structures. These structures typically include a frame, such as that indicated at 12. Frame 12 supports a gate panel 14 which may be solid or partially open to pass air and light. Gate panel 14 may be rigid and capable of self-support so that a separate frame is not required. Alternatively, panel 14 may be flexible or resilient. Regardless of the precise nature of frame 12 and gate panel 14, gate panel 14 is supported in vertical orientation by frame 12. Frame 12 further comprises vertical channels 16, 18 and horizontal upper channel 20 and horizontal lower channel 22.

Gate 10 of the type encompassed by the invention is intended to be easily installed and removed, although it may be permanently installed. Gate 10 has mounting apparatus 24 adapted to mount frame 12 in an erect position to at least one environmental surface (not shown). The mounting device forms no part of the invention and could be any of a variety which are known to the art.

Gate panel 14 is, typically, pivotally supported on one post 24 and latches to the other post 24 by a tongue 32 which is received in a suitable receptacle 34. Receptacle 34 will be understood to include apparatus for releasably retaining tongue 32 when tongue 32 enters receptacle 34. Pivotal support of gate panel 14 is accomplished by a suitable hinge or journaling arrangement indicated at 36. In the embodiment of FIG. 1, posts 24 are joined by a strut 38 which is firmly fixed to both, thereby preventing posts 24 from deflecting unduly as gate 10 is wedged between two opposing walls.

Typically, gate 10 has expansible members such as screws 28 which can be adjusted to contact or operably engage the walls or other fixed, permanent, generally vertical environmental surfaces, thereby supporting gate by wedging. However, other mounting elements may be substituted for screws 28. Illustratively, gate 10 may have elements (not shown) which project laterally from gate 10 by cam action or other actuation schemes to contact the supporting walls. In a further alternative, projecting eyes (not shown) for receiving fasteners (not shown) which may be driven into the supporting walls.

Thus far, features of gate 10 are generally conventional. Gate 10 departs from prior art gates in that it has integral illumination source for safety purposes. The electrically operated illumination source such as lamps 40 is supported on frame 12. Lamps 40 have reflective covers 42 adapted to reflect light downwardly onto the front side of gate panel 12. As employed herein, "front" is for semantic designation of one of the broad or large ends or faces of gate panel 12. The rear or opposed large end or face of gate panel 12 could also be illuminated by additional lamps (not shown) or by a different arrangement which will be described hereinafter.

Figure 2:
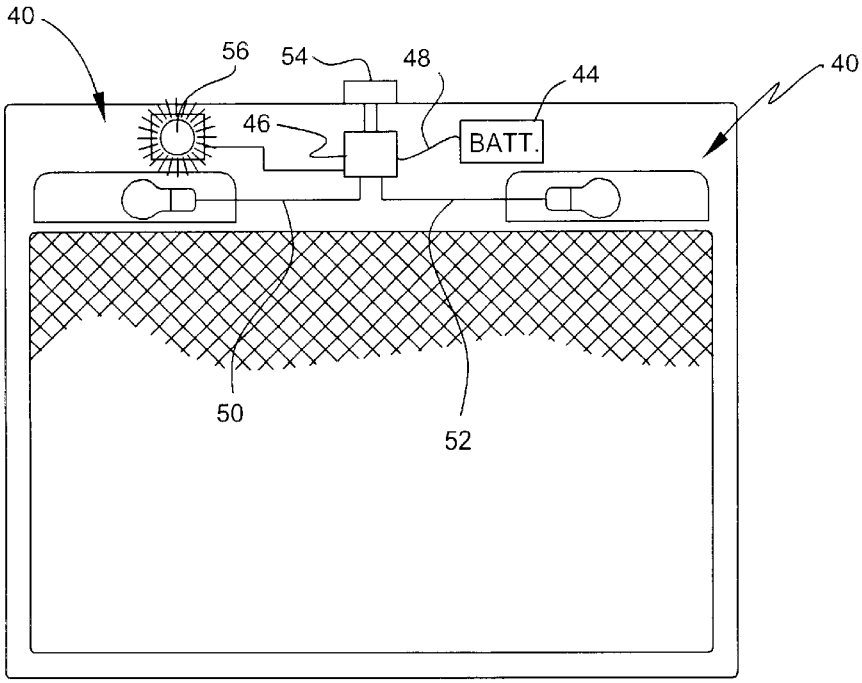
FIG. 2 is a diagrammatic, front elevational view of the embodiment of FIG. 1.

FIG. 2 shows the electrical system which operates lamps 40. The electrical system includes a source of electrical power such as battery 44, a control switch 46, and electrical conductors 48, 50, 52 connecting lamps 40 to battery 44. Conductors 48, 50, 52 will be understood to include the number of separate conductors required to accomplish the recited functions, even though they are depicted as a single element. It should also be understood that a power source other than a battery could be used. A control knob 54 accessible from the exterior of gate 10 operates switch 46. Switch 46 may turn lamps 40 on and off if desired. Alternatively, switch 46 may merely control intensity of light generated by lamps 40, leaving on-off control to other components. In the latter case, switch 46 may be a dimmer switch arranged to vary illumination of said illumination source in a continuous, progressive manner. Alternatively, switch 46 could be a three position switch arranged to limit illumination to three different levels. Both dimmer switches and three position switches and their circuitry are known, and will not be further described herein.

Figure 3:
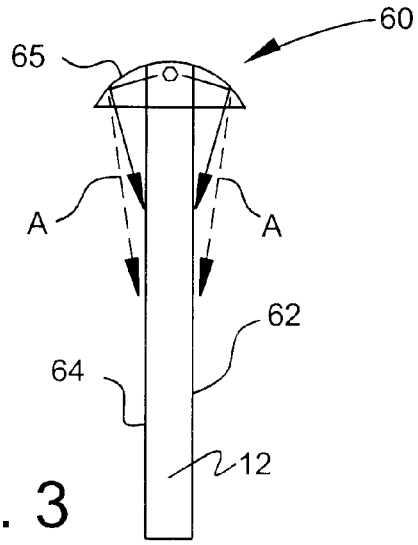
FIG. 3 shows an end elevational view of a second embodiment of the illumination system of the invention and FIG. 4 shows an end elevational view of a third embodiment of the illumination system of the invention.
Figure 4:
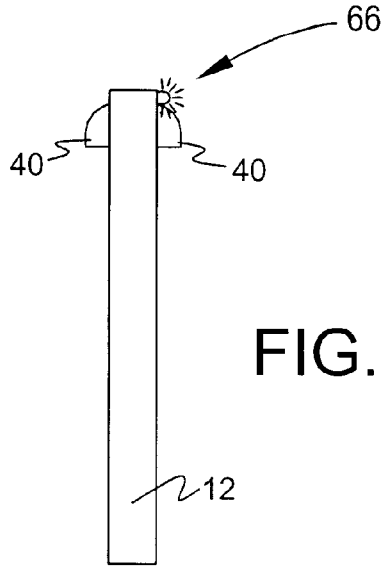

FIG. 3 illustrates how a single lamp 60 may be employed to project light to both front and rear sides 62, 64 of gate panel 12. Lamp 60 has a reflective cover 65 which overlaps both front and rear sides 62, 64, and is dimensioned and configured to reflect light as indicated by arrows A. In FIG. 4, an additional lamp 66 is configured to project light away from gate panel 12. This arrangement provides a visual signal which signals presence of gate 10, but does not directly illuminate gate 10.

Figure 5:
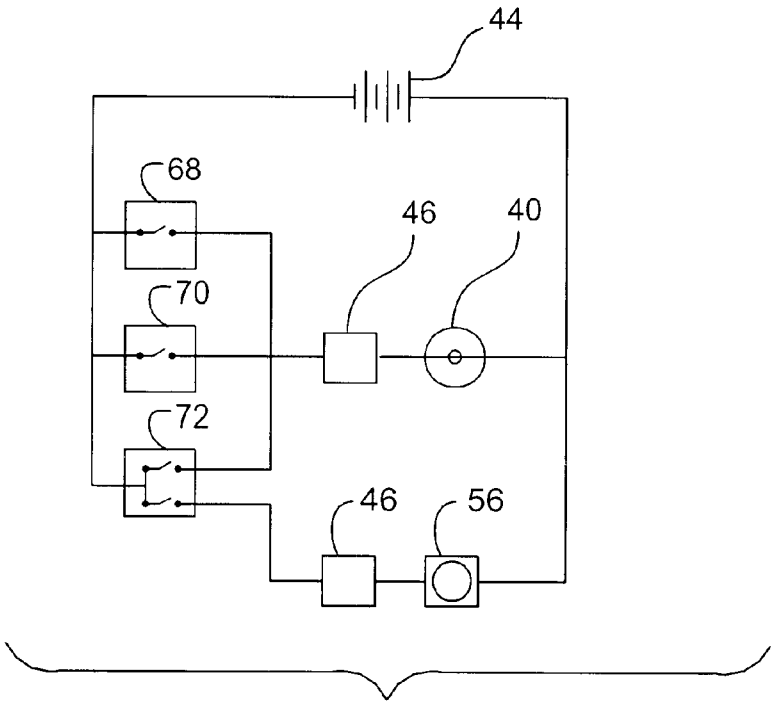
FIG. 5 is an electrical schematic illustrating a power and control scheme.

In preferred embodiments of the invention, the illumination source is operated by an automatic on-off controller. This automatic controller may take several forms, which may be employed singly or in any preferred combination. Referring now to FIG. 5, a programmable timer 68 operates the illumination source at predetermined times and extinguishes the illumination source at other times. In addition, a light-sensitive (photo-electric) switch 70 is included in the electrical system, and connects the illumination source to electrical power responsive to sensing a predetermined threshold of diminished ambient light levels. A motion sensor 72 is mounted on gate 10 in a suitable location for sensing motion within a predetermined distance of itself, and makes electrical connection responsive to sensing motion within its range. Motion sensor 72 may optionally control audible alarm 56 in addition to or in place of lamp(s) 40, 60 or 66. Audible alarm 56 could be a bell, horn, buzzer, speaker or any other audible alarm as is known in the art. It would be evident to one skilled in the art that the duration of illumination of lamps 40, 60 or 66 and the sounding of audible alarm 56 would be determined by the setting of motion sensor 72.

Figure 6:
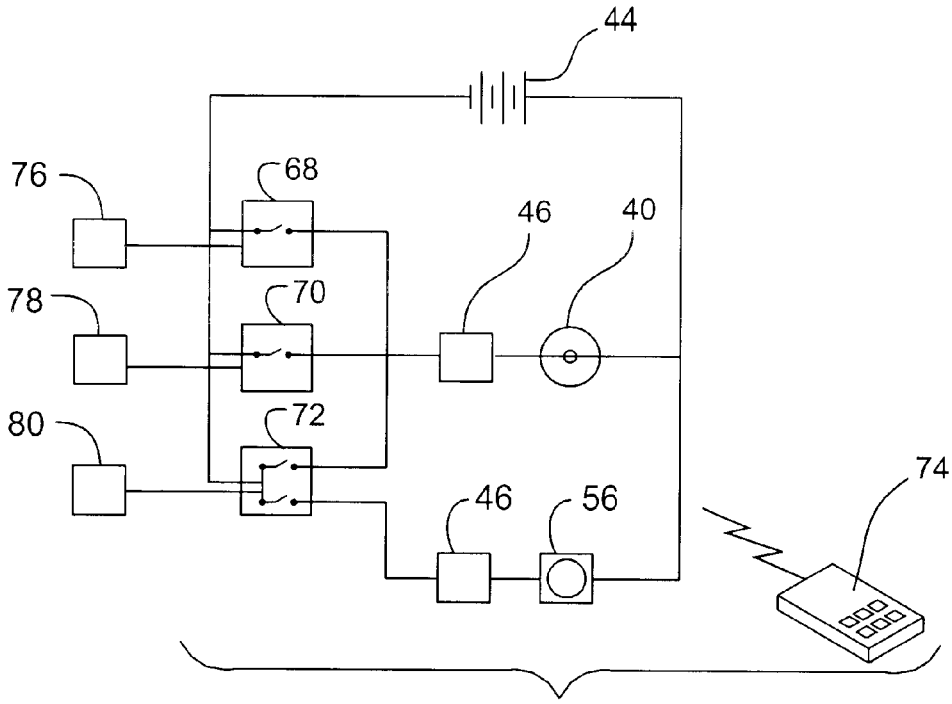
FIG. 6 is an electrical schematic illustrating remote control.

FIG. 6 illustrates an embodiment of the invention wherein a remote controller 74 generates command signals. A signal receiver 76, 78, or 80 is located on or proximate gate 10. Each signal receiver is adapted to receive the command signals and to control the illumination source by its respective controller 68, 70, or 72 responsive to command signals generated by remote controller 74. Remote controller 74 may operate on radio frequency signals, may generate infrared signals, or may utilize any suitable radiant energy signals. Receivers 76, 78, 80 will be understood to be connected to power of battery 44, or other external power source, although this feature is omitted for brevity in the drawings.

Figure 7:
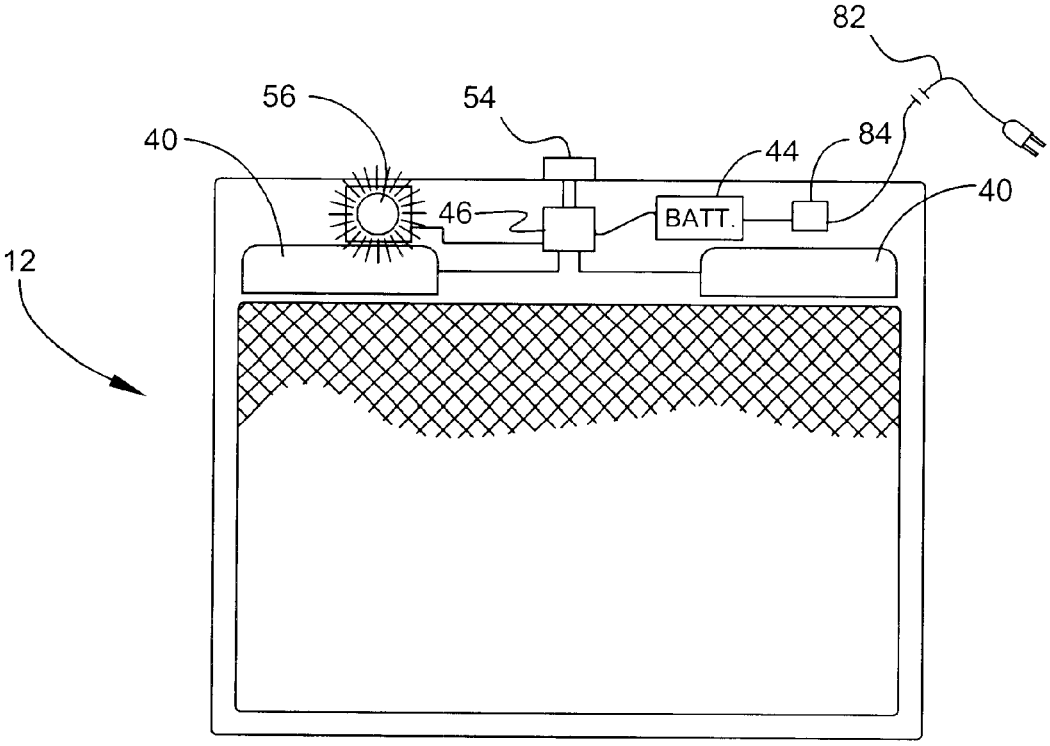
FIG. 7 is a diagrammatic, front view of still another embodiment of the invention.

As shown in FIG. 7, power may be derived from a plug and cord assembly 82. Plug and cord assembly 82 may be connected directly to lamp 40 and the electrical controls, or may be connected to a battery recharger 84, which is in turn connected to battery 44.

It is to be understood that the present invention is not limited to the embodiments described above, but encompasses any and all embodiments within the scope of the following claims.

I claim:

1. An illuminated gate for obstructing a passageway, comprising:

a frame;

a gate panel movably supported in a vertical orientation by said frame, and said panel having a front side and a rear side;

a mounting apparatus adapted to mount said frame to at least one environmental surface;

an integral electrically operated illumination source mounted in said gate panel, said illumination source being adapted to project light from generally opposite directions onto said front side and onto said rear side, said illumination source also projecting light away from one of said front side and said rear side of said gate panel; and an electrical system including a source of electrical power and electrical conductors for connecting said illumination source to said source of electrical power.

2. The gate, as defined in claim 1, further comprising an automatic on-off controller adapted to selectively operate said illumination source.

3. The gate, as defined in claim 2, wherein said automatic on-off controller comprises a light-sensitive switch adapted to connect said illumination source to said source of electrical power.

4. The gate, as defined in claim 2, wherein said automatic on-off controller comprises a programmable timer adapted to connect said illumination source to said source of electrical power at predetermined times and to disconnect said illumination source from said source of electrical power at other times.

5. The gate, as defined in claim 2, wherein said automatic on-off controller comprises a motion sensor adapted to connect said illumination source to said source of electrical power in response to sensing motion within a predetermined distance of said motion sensor.

6. The gate, as defined in claim 5, wherein said motion sensor is connected to an audible alarm.

7. The gate, as defined in claim 1, further comprising a manual controller adapted to control intensity of said illumination source.

8. The gate, as defined in claim 7, wherein said manual controller is arranged to limit illumination to three different levels of illumination.

9. The gate, as defined in claim 7, wherein said manual controller is arranged to vary illumination from said illumination source in a continuous, progressive manner.

10. The gate, as defined in claim 1, wherein said electrical source of power comprises a cord and plug assembly adapted for connecting said electrical conductors to an external power source.

11. The gate, as defined in claim 1, wherein said electrical source of power comprises a battery mounted on said gate panel.

12. The gate, as defined in claim 11, wherein said electrical system includes a battery charger adapted for connection to said battery and a cord and plug assembly adapted for connection to said battery charger.

13. The gate as defined in claim 1, further comprising a remote controller adapted to generate command signals, and a signal receiver located on said gate panel, wherein said signal receiver is adapted to receive the command signals and to control said illumination source responsive to the command signals generated by said remote controller.

14. An illuminated gate for obstructing a passageway, comprising:

a frame;

a gate panel movably supported in a vertical orientation by said frame, and said panel having a front side and a rear side;

a mounting apparatus adapted to mount said frame to at least one environmental surface;

an integral electrically operated illumination source mounted in said gate panel, said illumination source being adapted to project light from generally opposite directions onto said front side and onto said rear side, said illumination source also projecting light away from one of said front side and said rear side of said gate panel; and an electrical system including at least one of:

a) a battery mounted on said gate panel and electrical connectors adapted for connecting said illumination source to said battery, b) a battery mounted on said gate panel, a battery charger adapted for connection to said battery, a cord and plug assembly adapted for connection to said battery charger and to an external power source, and electrical conductors adapted for connecting said illumination source to said battery, and c) a cord and plug assembly adapted for connection of said illumination source to an external power source;

an on-off controller adapted to operate said illumination source at predetermined times and to extinguish said illumination source at other times, wherein said automatic on-off controller comprises at least one of:

a) a light sensitive switch responsive to sensing a predetermined threshold of ambient light, b) a programmable timer, c) a motion sensor responsive to sensing motion within a predetermined distance of said motion sensor, d) a manual controller adapted to control intensity of said illumination source, wherein said manual controller is arranged to one of limit illumination from said illumination source to three different levels and vary said illumination from said illumination source in a continuous, progressive manner, and e) a remote controller adapted to generate command signals, and a signal receiver located on said gate panel wherein said signal receiver is adapted to receive the command signals and to control said illumination source responsive to said command signals generated by said remote controller.

15. The gate, as defined in claim 14, wherein said motion sensor is further adapted for connection to an audible alarm device.

* * * * *